United States Patent [19]

Sauer et al.

[11] 4,065,378

[45] Dec. 27, 1977

[54] MOUNTING MAGAZINE FOR A GALVANIC FIXTURE FOR ELECTROPLATING SEMICYLINDRICAL ARTICLES

[75] Inventors: Friedrich Sauer, Heidenrod; Klaus Müller, Naurod, Taunus, both of Germany

[73] Assignee: Glyco-Metallwerke Daelen & Loos GmbH, Wiesbaden-Schierstein, Germany

[21] Appl. No.: 632,847

[22] Filed: Nov. 17, 1975

[51] Int. Cl.[2] ..... C25D 17/06; C25D 17/08

[52] U.S. Cl. ..... 204/297 W; 204/275

[58] Field of Search ..... 204/281, 297, 297 R, 204/297 W, 297 M, 280

[56] References Cited

U.S. PATENT DOCUMENTS

| | | | |
|---|---|---|---|
| 2,727,858 | 12/1955 | Klein | 204/297 W |
| 2,761,831 | 9/1956 | Luechauer | 204/297 W |
| 2,944,945 | 7/1960 | Allison | 204/15 |
| 3,779,890 | 12/1973 | Witney et al. | 204/290 R |

FOREIGN PATENT DOCUMENTS

| | | | |
|---|---|---|---|
| 573,635 | 11/1945 | United Kingdom | 204/297 W |

*Primary Examiner*—F.C. Edmundson

*Attorney, Agent, or Firm*—Strauch, Nolan, Neale, Nies & Kurz

[57] ABSTRACT

A magazine for containing a stacked column of semicylindrical articles during electroplating comprising a body of electrically insulating material of generally half cylindrical cross-section formed with a multiplicity of through holes for electrolyte flow and having at one end a bottom section mounting a metal surface for supporting one end of the column and at the other end a head section mounting a metal plate in electrical contact to the other end of said column and external springs for maintaining the magazine under longitudinal pressure in a galvanic holding mixture.

8 Claims, 6 Drawing Figures

Fig. 1
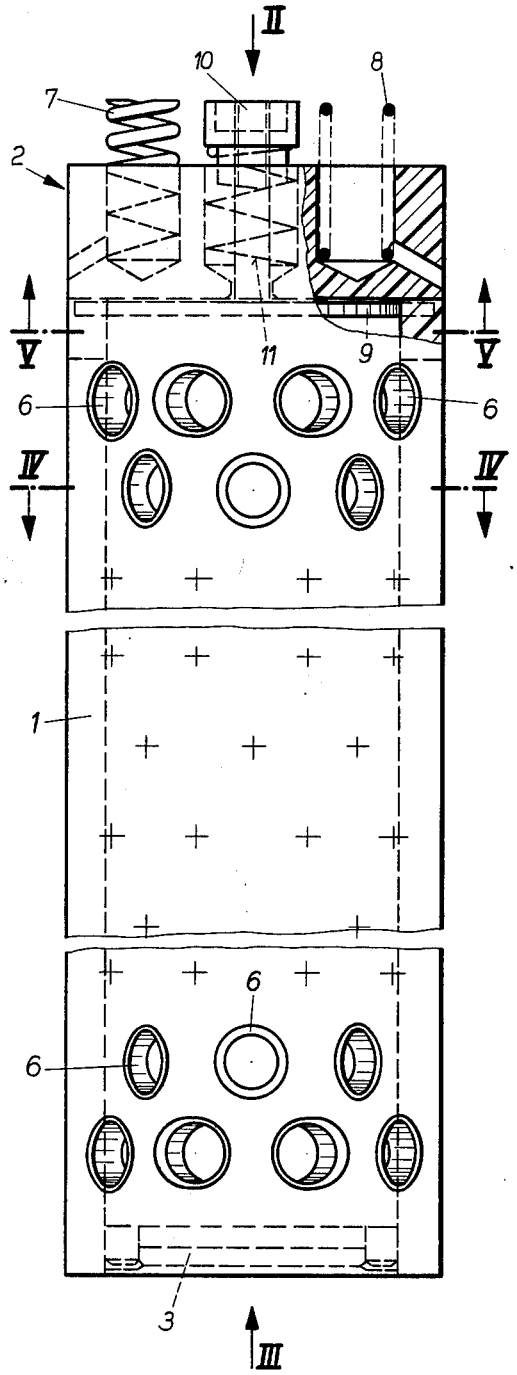
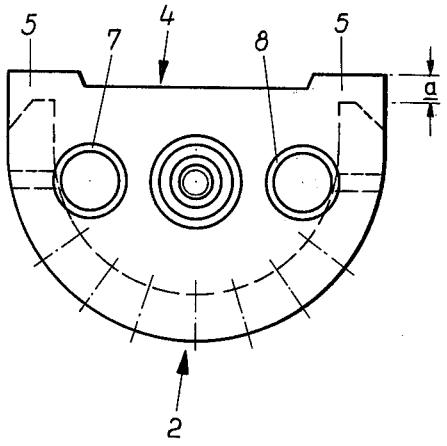
Fig. 2
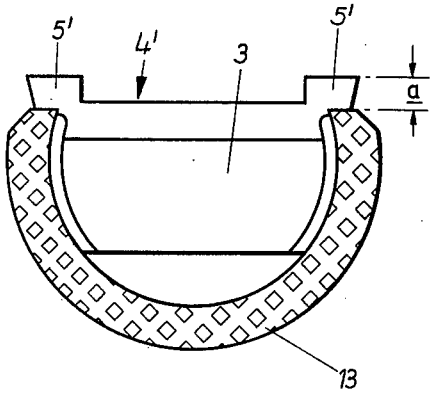
Fig. 3

Fig. 4
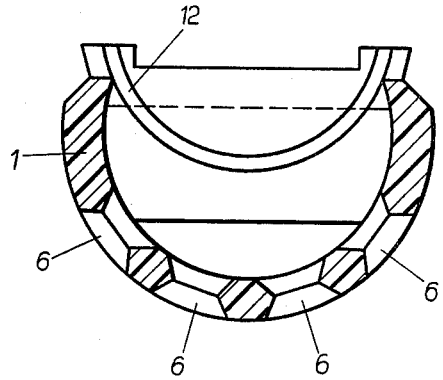
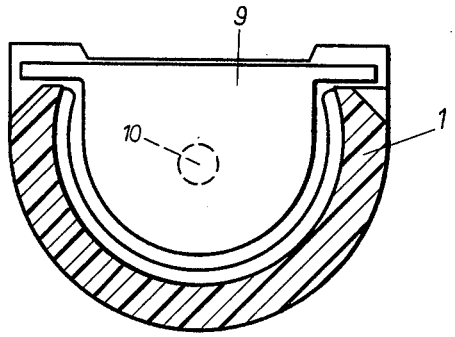
Fig. 5

MOUNTING MAGAZINE FOR A GALVANIC FIXTURE FOR ELECTROPLATING SEMICYLINDRICAL ARTICLES

This invention is concerned with a magazine or holder for a stacked column of semicylindrical articles, such as radial journal bearing halves, and is suitable for installation in a galvanic holding fixture to make possible uniform thickness metallic deposits on the articles.

Prior to insertion of the journal bearing halves which are to be electroplated in a galvanic holding fixture, it is known to align such journal bearing halves in a prism corresponding to the length of the mounting magazine, and the galvanic holding fixture is then placed over this aligned column. In such case, considerable longitudinal pressure is exerted on the column. If the faces of the radial journal bearing halves are irregular or not parallel, the column may collapse under pressure which is exerted by the clamping and contact components in the galvanic holding fixture. The formation of a column and its stability thus determines the quality and the precision of electroplating of the faces of the respective bearing halves.

In order to be able to accept radial journal bearing halves with irregular faces, a galvanic holding fixture is known with which radial journal bearing halves can be electroplated on one side (British Pat. No. 1,343,814). The disadvantage of this galvanic holding fixture lies not only in the complicated, costly, and difficult to maintain construction, but also in the long loading and unloading time which cannot be suited to the timing of an automatic galvanic device. Another disadvantage is in the one-sided electroplating.

It is therefore an object of the present invention to provide a novel auxiliary magazine for available galvanic holding fixtures with which complete and reliable electroplating of radial journal bearing halves with irregular faces can be carried out.

This may be accomplished in accord with the invention by providing a novel magazine that has a semicircular configuration and, at its head, is provided with a device for fixing the magazine in the galvanic holding fixture, and, at its foot, has a baseplate arranged to prevent sliding through of the contained column of radial journal bearing halves.

Within the scope of this invention, it is of advantage that the mounting magazine can be produced by thermoplastic foam casting. However, it is also possible to produce the mounting magazine from adhesively secured or welded components.

An additional advantage of the mounting magazine in accord with this invention lies in the fact that it does not affect the timing of the automatic galvanic device.

On its underside, the head of the mounting magazine of the invention has a movable metallic clamping plate, which also serves as an electrical contact and which is loaded by the available and known clamping and contact component of the galvanic holding fixture. At the same time, the mounting magazine is fixed in position in the electroplating apparatus by means of springs which are solidly mounted in its head, so that the column is not subjected to the pressures required to hold the magazine in position. These measures, the arrangement of the metallic clamping plate and of the solidly mounted springs in the head, result in the advantage that the available and known clamping and contact components of the conventional galvanic holding fixture can be used without change.

Another advantage of the mounting magazine in accord with this invention is that, as a function of the mounting conditions of the conventional galvanic mounting fixture, it is suitable for fixing various size ranges of diameters, i.e. a column of radial journal bearing halves can be inserted in the mounting magazine having a considerably larger or smaller diameter than the mounting magazine itself.

BRIEF DESCRIPTION OF THE DRAWINGS

FIG. 1 is a plan view of a mounting magazine according to a preferred embodiment of the invention;

FIG. 2 is a top view of the mounting magazine of FIG. 1 looking in the direction of the arrow II in FIG. 1;

FIG. 3 is a bottom plan view, looking in the direction of the arrow III in FIG. 1;

FIG. 4 is a section substantially on line IV—IV of FIG. 1;

FIG. 5 is a section substantially on line V—V in FIG. 1 and

PREFERRED EMBODIMENTS

Figure 6:
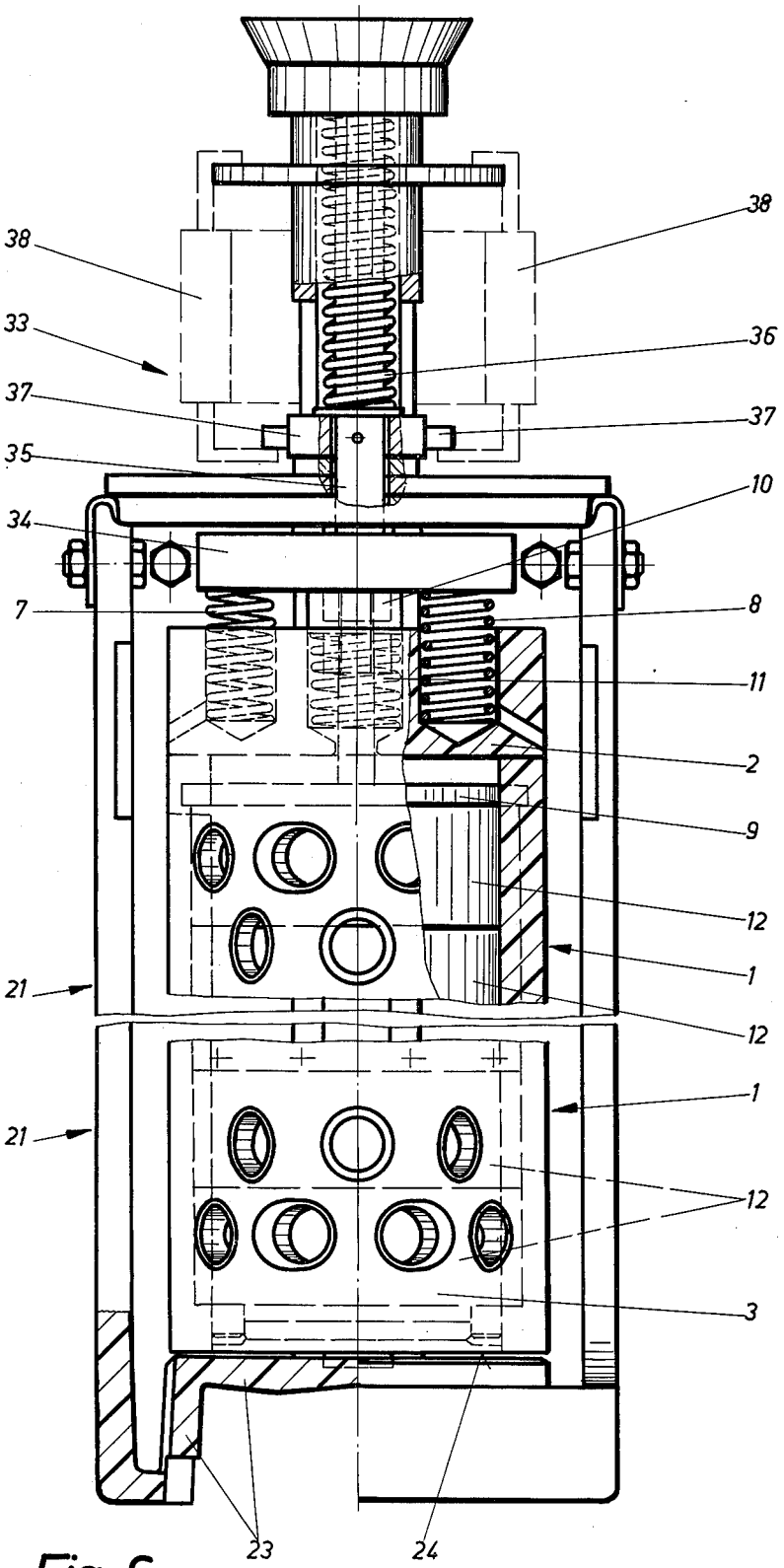
FIG. 6 is a view from below of a mounting magazine of FIG. 1 and an overlayed mounting and holding fixture partially broken away.

The magazine comprises a center piece or body 1, a head 2, and a foot 3. Head 2 and foot 3 are secured as by welding to the respective ends of the center piece 1 and are so configured, or so inserted into center piece 1, that the respective upper edges of head 2 and foot 3 extend beyond the upper edge of center piece 1 by a predetermined distance *a* as shown in FIGS. 2 and 3. As shown in FIGS. 3 and 4, center piece 1 is an arcuate or generally cylindrical half annulus in transverse section and the head and foot project outwardly with respect to the open end side edges of center piece 1. Electrolyte flows in or out without constraint at through holes 6 (see also FIG. 4) which are located in staggered arrangement over the entire length and circumference of center piece 1.

The protruding edges of head 2 and foot 3 are provided with recesses 4, 4' in the central area so that the mounting magazine rests in the galvanic holding fixture only on the edges 5, 5'. Since center piece 1 is provided with staggered through holes the electrolyte can flow in or flow out without constraint and the back or convex sides of the bearing halves can be electroplated.

On each side of head 2, two solidly supported springs 7, 8 are provided. They serve to fix and maintain the magazine in the galvanic holding fixture. A metal clamping plate 9 (see FIG. 5), which functions as an electrical contact and is welded to a metal bolt 10, is seated on the underside of head 2. The metal bolt 10 is screwed into a PVC head, which is pressed towards the top by means of a spring 11.

Prior to the insertion of the magazine into a galvanic holding fixture, the magazine is filled with a stacked end to end column of radial journal bearing halves. The journal bearing halves automatically align themselves during insertion into the magazine. The electrical contact from the galvanic holding fixture to the mounting magazine, and to the journal bearing halves of the column, is made through the metal clamping plate 9 and through a known clamping and contact component of the galvanic holding fixture. The magazine is held in position in the fixture by the solidly mounted springs 7, 8 in the head, so that the contained column of radial journal bearing halves is not subjected to undue pressure and does not collapse.

As shows in FIG. 4, the radial journal bearing halves 12 in the column are not clamped on the magazine center piece 1, but are supported freely on the edges of the inside diameter of the center piece 1. In this manner, no substantial pressure is exerted on the radial journal bearing halves by the mounting magazine. The available clearance is not so great that the column of journal bearing halves would collapse under the pressure of the clamping component (not illustrated) of the galvanic holding fixture.

As shown in FIG. 3, the support surface at the bottom is provided with a friction or knurled area 13 in order to assure a secure positioning of the mounting magazine which is under longitudinal pressure.

FIG. 6 shows from below a magazine 1 according to FIGS. 1 to 5 and a fixture unit 21 laid over the said magazine 1.

Spring 11 contained in the head 2 of the magazine 1 is provided to move plate 9 to the lower side of the head portion 2 so that the inner space of the magazine is entirely free if the magazine is outside the galvanic fixture means. To insert the articles 12 to be treated the magazine is brought in a position as shown in FIG. 4, and the articles 12 are laid over the substantially semicircular magazine wall between foot 3 and plate 9. (Plate 9 being urged in contact with the lower or inner surface of head 2 by means of the spring 11.)

After the magazine has been filled by a column of articles 12, the fixture means 21 is laid over the open side of the magazine 1 and the column of articles 12 contained in the magazine. The main body of such a fixture is shown and described in the copending application for U.S. Pat. of Heinz Beck, Klaus Muller and Gerhard Erdelen Ser. No. 632,810 filed of even date herewith. Additionally to such body a fixture has a fixture head 33 containing a pressure bar 34 which extends over the springs 7 and 8 and bolt 10 of the magazine if the fixture is laid over the magazine. The said pressure bar 34 is operatively connected through a rod 35 with a pressure coil spring 36 which is stronger tham the coils 7 and 8 and 11 of the magazine together. Furtheron rod 35 is provided with lateral lugs 37 which are engaged by a tool as shown schematically at 38 to stretch spring 26 and to hold it in stretch condition. After the fixture 21 has been laid over the filled magazine 1, spring 36 is released by the tool 38, and so spring 36 urges the pressure bar 34 against the springs 7 and 8 of the magazine 1 as well as against bolt 20. Thereby spring 36 partially releases and stretches springs 7 and 8 and 11. By overcoming force of spring 11 the spring 36 of the fixture urges plate 9 against the column of articles 12 in a modified manner, at the same time spring 36 urges the magazine 1 through springs 7 and 8 against the surface 24 of the platform 23 of the fixture body. So the magazine 1 and the articles 12 inserted thereto are held in their position only by the force of spring 36. After the articles have been treated and the fixture and the magazine have been removed from the galvanic bath spring 36 is again stretched by means of the tool 38 so that the magazine and the articles contained therein may be removed from the fixture 31.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for containing a stacked end to end column of semi-cylindrical articles during electroplating comprising a galvanic holding fixture adapted for mounting and providing electrical contact in a galvanic bath system and a magazine that is open along one side; said holding fixture comprising a fixture head, a fixture body connected at one end to said fixture head and adapted to be laid over the open side of said magazine, a platform at the other end of said body, and means for maintaining said magazine under longitudinal pressure between said head and said platform; and said magazine having a magazine body wall of electrically insulating material of generally half-cylindrical cross section formed with a multiplicity of openings located in staggered arrangement over the entire length and circumference of said magazine body wall for through flow of electrolyte, with opposite longitudinal side edges of said wall defining said open side of the magazine and being so disposed as to laterally support the column of semicylindrical articles by engagement with the outer convex surfaces of all of said articles, a bottom section supporting said column with said articles in said lateral engagement with said side edges and with the concave surfaces of said articles facing away from said longitudinal opening, and a head section having means providing electrical contact under longitudinal pressure to the other end of said column.

2. The apparatus defined in claim 1, wherein said means on the magazine head section providing electrical contact under longitudinal pressure to the article column comprises a spring biased contact member movably mounted on said magazine head section with one end adapted for engagement with said other end of the column in the assembly.

3. Apparatus in accord with claim 2, characterized in that said electrical contact member comprises a metal plate on the underside of said magazine head section adapted to be contacted by said other end of said column.

4. Apparatus as defined in claim 3, wherein said plate is fixed on an electrically conductive bolt resiliently biased by a spring in said magazine head section.

5. Apparatus in accord with claim 1, characterized in that said head and bottom sections of the magazine project laterally with respect to the edges of the open side of said magazine body.

6. Apparatus in accord with claim 1, characterized in that said means for maintaining the magazine under longitudinal pressure comprises external compression springs on said magazine head section.

7. Apparatus as defined in claim 1, wherein the bottom of said magazine body is externally irregularly surfaced for holding friction in said fixture.

8. The apparatus defined in claim 1, wherein said means for maintaining the magazine under longitudinal pressure comprises resilient means on the head section of said magazine that is compressed when the fixture and magazine are assembled together.

* * * * *

UNITED STATES PATENT OFFICE

CERTIFICATE OF CORRECTION

Patent No. 4,065,378 Dated December 27, 1977

Inventor(s) Friedrich Sauer and Klaus Muller

It is certified that error appears in the above-identified patent and that said Letters Patent are hereby corrected as shown below:

Column 3, line 48 change "26" to --36--.

On the cover page, the foreign priority data has been omitted. Please insert: --German application No. P 24 54 624.5 filed November 18, 1974--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*